US009589509B2

(12) United States Patent
Lee et al.

(10) Patent No.: US 9,589,509 B2
(45) Date of Patent: Mar. 7, 2017

(54) LIGHT EMISSION CONTROL DRIVER, LIGHT EMISSION CONTROL AND SCAN DRIVER AND DISPLAY DEVICE

(71) Applicant: EverDisplay Optronics (Shanghai) Limited, Shanghai (CN)

(72) Inventors: Ching-hung Lee, Shanghai (CN); Ying-Hsiang Tseng, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 111 days.

(21) Appl. No.: 14/596,906

(22) Filed: Jan. 14, 2015

(65) Prior Publication Data

US 2015/0294619 A1 Oct. 15, 2015

(30) Foreign Application Priority Data

Apr. 10, 2014 (CN) ..... 2014 1 0142701

(51) Int. Cl.
*G09G 3/30* (2006.01)
*G09G 3/32* (2016.01)

(52) U.S. Cl.
CPC ..... *G09G 3/3266* (2013.01)

(58) Field of Classification Search
CPC ..... G09G 3/3266; G09G 2310/0286; G09G 2310/0289
USPC ..... 377/64, 70
See application file for complete search history.

(56) References Cited

U.S. PATENT DOCUMENTS 9,368,069 B2 * 6/2016 Woo ..... G09G 3/3266
2005/0264496 A1 * 12/2005 Shin ..... G09G 3/3233 345/76
2009/0256785 A1 * 10/2009 Sung ..... G09G 3/3258 345/77

(Continued)

FOREIGN PATENT DOCUMENTS

CN 103310748 A 9/2013
EP 1978503 A2 10/2008

(Continued)

OTHER PUBLICATIONS

Office Action issued Aug. 18, 2015 by the JP Office.

(Continued)

*Primary Examiner* — Lixi C Simpson
(74) *Attorney, Agent, or Firm* — Yunling Ren

(57) ABSTRACT

The present application relates to a light emission control and scan driver and a display device having the drivers. A light emission control and scan driver includes a plurality of driver stages for outputting light emission control signals and scan signals, each of which including: a light emission control driving unit for providing control signals to the scan units and a scan driving unit. Control signals may be light emission control signals. The light emission control driving unit has a first input signal terminal, a first clock terminal, a second clock terminal and a light emission control output terminal, and outputs light emission control signals at the light emission control output terminal based on input signals input at the first input signal terminal, light emission timing control signals input at the first clock terminal and inverted light emission timing control signals input at the second clock terminal.

14 Claims, 10 Drawing Sheets

(56) References Cited

U.S. PATENT DOCUMENTS

| | | | | |
|---|---|---|---|---|
| 2014/0111403 | A1* | 4/2014 | Kim | G11C 19/28 345/76 |
| 2014/0266401 | A1* | 9/2014 | Park | H03K 3/012 327/434 |
| 2015/0015554 | A1* | 1/2015 | Kim | G09G 3/3208 345/208 |

FOREIGN PATENT DOCUMENTS

| | | | |
|---|---|---|---|
| JP | H08220506 | A | 8/1996 |
| JP | 2008250093 | A | 10/2008 |
| JP | 2009004757 | A | 1/2009 |
| JP | 2011076102 | A | 4/2011 |
| JP | 2014029529 | A | 2/2014 |
| KR | 1020050123480 | A | 12/2005 |
| KR | 100807062 | B1 | 2/2008 |
| TW | 201140533 | A1 | 11/2011 |
| TW | 201234344 | A1 | 8/2012 |
| TW | 201335913 | A1 | 9/2013 |
| TW | 201351373 | A | 12/2013 |

OTHER PUBLICATIONS

Partial European search report issued Nov. 24, 2015 by the EP Office.
Office Action issued Feb. 25, 2016 by the TW Office.
Office Action issued Mar. 8, 2016 by the KR Office.

* cited by examiner

600

LIGHT EMISSION CONTROL DRIVER, LIGHT EMISSION CONTROL AND SCAN DRIVER AND DISPLAY DEVICE

CROSS-REFERENCE TO RELATED APPLICATIONS

This application claims benefits of Chinese Patent Application No. 201410142701.9, filed on Apr. 10, 2014 in the State Intellectual Property Office of China, the disclosure of which is incorporated herein by reference in its entirety.

TECHNICAL FIELD

The present disclosure relates to a display device, particularly to a light emission control driver, a light emission control and scan driver and a display device having the driver.

BACKGROUND ART

Organic light emitting diode (OLED) display devices, as a new generation of display device technology, have advantages of self luminescence, large viewing angle, high contrast, low power consumption, high response speed, high resolution, full colors and thin form factor. AMOLED might be one of future potential main stream display device technologies.

As shown in FIG. 1, a conventional OLED display device includes a scan driver 10, a data driver 20, a light emission control driver 30 and a pixel array 40. The pixel array 40 has a plurality of pixels 50, which are connected to scan lines S1 to Sn, data lines D1 to Dm and light emission control lines E1 to En respectively. The scan driver 10 is configured to provide scan signals to scan lines S1 to Sn successively, the data driver 20 is configured to provide data signals to data lines D1 to Dm, while the light emission control driver is configured to provide light emission control signals to light emission control lines E1 to En.

When scan signals are supplied to scan lines successively, pixel rows connected with scan lines are selected. Accordingly, the selected pixels receive data signals (data voltages) from data lines. The data voltages control currents flowing from the power supply ELVDD to the OLEDs, and hence control the OLEDs to generate light with corresponding luminance, and thereby display images. The duration for a pixel to emit light is controlled by a light emission control signal from a light emission control line.

The scan driver 10, the data driver 20 and the light emission control driver 30 are controlled by a timing controller 60. The timing controller 60 may provide scan driving control signals (SDS) to the scan driver 10, provide data driving control signals (DDS) to the data driver 20, and provide light emission driving control signals (EDS) to the light emission control driver 30. The timing controller 60 can control the pulse width and/or the number of pulses of the light emission control signals output from the light emission control driver 30 by controlling the light emission driving control signals (EDS).

According to a conventional design, the scan driver 10 and the light emission control driver 30 are driven by different control timing signals respectively and independently. It is desired to have an effective simplified circuit design to reduce TFT elements and/or control timing signals required by the circuit.

The above information disclosed in this Background section is only for enhancement of understanding of the background of the disclosure and therefore it may contain information that does not form the prior art that is already known in this country to the person of ordinary skill in the art.

SUMMARY OF INVENTION

The present application discloses a light emission control driver, a light emission control and scan driver and an organic light emitting display device having the drivers that can effectively simplify circuit design and reduce TFT elements and/or control timing signals required by the circuit.

Other features and advantages of the present disclosure will become apparent through the following detail description or will be partially learned by practicing the present disclosure.

According to an aspect of the present disclosure, there is provided a light emission control and scan driver comprising a plurality of driver stages for outputting light emission control signals and scan signals. Each driver stage may comprise:

a light emission control driving unit having a first input signal terminal, a first clock terminal, a second clock terminal and a light emission control output terminal and configured to output light emission control signals at the light emission control output terminal based on input signals input at the first input signal terminal, light emission timing control signals input at the first clock terminal and inverted light emission timing control signals input at the second clock terminal. The inverted light emission timing control signals are inverted signals of the light emission timing control signals; and a scan driving unit having a second input signal terminal, a third clock terminal, a fourth clock terminal and at least one scan output terminal and configured to output at least one scan signal at the at least one scan output terminal according to control signals based on the light emission control signals of the light emission control driving unit input at the second input signal terminal, first scan timing control signals input at the third clock terminal and second scan timing control signals input at the fourth clock terminal.

For example, the control signals are the light emission control signals.

For example, the light emission control driving unit comprises a first controlled inverter, a second controlled inverter and a third inverter. Each of the first controlled inverter and the second controlled inverter comprises a first input terminal, a second input terminal, a third input terminal and an output terminal, and the first controlled inverter and the second controlled inverter are configured that: when the second input terminal is at low level and the third input terminal is at high level, the first controlled inverter and the second controlled inverter are turned on and output signals at the output terminal with reversed phases to signals at the first input terminal, and when the second input terminal is at high level and the third input terminal is at low level, the first controlled inverter and the second controlled inverter are turned off. The first input terminal, the second input terminal and the third input terminal of the first controlled inverter are respectively electrically coupled to the output terminal of the third inverter, the second clock terminal and the first clock terminal, and the output terminal of the first controlled inverter is electrically coupled to the input terminal of the third inverter. The first input terminal, the second input terminal and the third input terminal of the second controlled inverter are respectively electrically coupled to the first input signal terminal, the second clock terminal and the first clock terminal of the light emission control driving unit, and the output terminal of the second controlled inverter is electrically coupled to the input terminal of the third inverter.

For example, the output terminal of the third inverter is directly or indirectly electrically coupled to the light emission control output terminal of the light emission control driving unit.

For example, each of the first controlled inverter and the second controlled inverter comprises: a first transistor, a second transistor, a third transistor and a fourth transistor. The first transistor and the second transistor are NMOS transistors, and the third transistor and the fourth transistor are PMOS transistors. A source node of the second transistor and a drain node of the third transistor are electrically coupled to the output terminal, gate nodes of the second transistor and the third transistor are electrically coupled to the first input terminal, a drain node of the second transistor is electrically coupled to a source node of the first transistor, and a source node of the third transistor is electrically coupled to a drain node of the fourth transistor. A drain node of the first transistor is electrically coupled to a second power supply, and a gate node of the first transistor is electrically coupled to the third input terminal. A source node of the fourth transistor is electrically coupled to a first power supply, and a gate node of the fourth transistor is electrically coupled to the second input terminal.

For example, the plurality of driver stages comprise a first driver stage to a nth driver stage and are configured such that the first input signal terminal of the first driver stage receives start pulse signals, and the first input signal terminals of other driver stages receive light emission control signals output from the light emission control output terminals of a previous driver stage.

For example, the start pulse signal has a pulse width equal to or greater than that of the light emission timing control signal.

For example, the scan driving unit comprises at least one output unit each comprising:

a first output transistor having a source node electrically coupled to a first power supply, a drain node electrically coupled to one scan output terminal of the at least one scan output terminal and a gate node electrically coupled to the second input signal terminal, and configured to be turned on or off based on the control signals input at the second input signal terminal;

a first output unit having an input terminal electrically coupled to one of the third clock terminal and the fourth clock terminal and an output terminal electrically coupled to the one scan output terminal, and configured to be turned on or off according to the control signals input at the second input signal terminal.

For example, the first output unit is configured to output signals input at the input terminal while being turned on.

For example, the first output unit comprises complementary second output transistor and third output transistor. A source node of the second output transistor and a source node of the third output transistor are electrically coupled to an input terminal of the first output unit, a drain node of the second output transistor and a drain node of the third output transistor are electrically coupled to an output terminal of the first output unit, a gate node of the second output transistor is configured to be electrically coupled to the control signals, and a gate node of the third output transistor is configured to be electrically coupled to an inverted signal of the control signal.

For example, the scan driving unit comprises a fourth inverter, a first output transistor, a second output transistor, complementary third output transistor and fourth output transistor, complementary fifth output transistor and sixth output transistor, the at least one scan output terminal comprising a first scan output terminal and a second scan output terminal. An input terminal of the fourth inverter is electrically coupled to an output terminal of the third inverter. A source node of the first output transistor is electrically coupled to a first power supply, a drain node of the first output transistor is electrically coupled to the first scan output terminal, and a gate node of the first output transistor is electrically coupled to an output terminal of the third inverter. A source node of the second output transistor is electrically coupled to a first power supply, a drain node of the second output transistor is electrically coupled to the second scan output terminal, and a gate node of the second output transistor is electrically coupled to an output terminal of the third inverter. Source nodes of the third output transistor and the fourth output transistor are electrically coupled to each other and with the third clock terminal, drain nodes of the third output transistor and the fourth output transistor are electrically coupled to each other and with the first scan output terminal, a gate node of the third output transistor is electrically coupled to an output terminal of the third inverter, and a gate node of the fourth output transistor is electrically coupled to an output terminal of the fourth inverter. Source nodes of the fifth output transistor and the sixth output transistor are electrically coupled to each other and with the fourth clock terminal, drain nodes of the fifth output transistor and the sixth output transistor are electrically coupled to each other and with the second scan output terminal, a gate node of the fifth output transistor is electrically coupled to an output terminal of the third inverter, and a gate node of the sixth output transistor is electrically coupled to an output terminal of the fourth inverter.

For example, for odd numbered driver stages, the first clock terminal and the second clock terminal are configured to receive the light emission timing control signals and the inverted light emission timing control signals respectively, and the third clock terminal and the fourth clock terminal are configured to receive the first scan timing control signals and the second scan timing control signals respectively. For even numbered driver stages, the first clock terminal and the second clock terminal are configured to receive the inverted light emission timing control signals and the light emission timing control signals respectively, and the third clock terminal and the fourth clock terminal are configured to receive the second scan timing control signals and the first scan timing control signals respectively.

According to another aspect of the present disclosure, there is provided a light emission control driver comprising a plurality of driver stages for outputting light emission control signals. Each driver stage may comprise:

a light emission control driving unit having a first input signal terminal, a first clock terminal, a second clock terminal and a light emission control output terminal and configured to output light emission control signals at the light emission control output terminal based on input signals input at the first input signal terminal, light emission timing control signals input at the first clock terminal and inverted light emission timing control signals input at the second clock terminal. The inverted light emission timing control signals are inverted signals of the light emission timing control signals.

For example, the light emission control driving unit comprises a first controlled inverter, a second controlled inverter and a third inverter. Each of the first controlled inverter and the second controlled inverter comprises a first input terminal, a second input terminal, a third input terminal and an output terminal, and the first controlled inverter and the second controlled inverter are configured that: when the second input terminal is at low level and the third input terminal is at high level, the first controlled inverter and the second controlled inverter are turned on and output signals at the output terminal with reversed phases of signals at the first input terminal, and when the second input terminal is at high level and the third input terminal is at low level, the first controlled inverter and the second controlled inverter are turned off. The first input terminal, the second input terminal and the third input terminal of the first controlled inverter are respectively electrically coupled to the output terminal of the third inverter, the second clock terminal and the first clock terminal, and the output terminal of the first controlled inverter is electrically coupled to the input terminal of the third inverter. The first input terminal, the second input terminal and the third input terminal of the second controlled inverter are respectively electrically coupled to the first input signal terminal, the second clock terminal and the first clock terminal of the light emission control driving unit, and the output terminal of the second controlled inverter is electrically coupled to the input terminal of the third inverter.

For example, the output terminal of the third inverter is directly or indirectly electrically coupled to the light emission control output terminal of the light emission control driving unit.

For example, each of the first controlled inverter and the second controlled inverter comprises: a first transistor, a second transistor, a third transistor and a fourth transistor. The first transistor and the second transistor are NMOS transistors, and the third transistor and the fourth transistor are PMOS transistors. A source node of the second transistor and a drain node of the third transistor are electrically coupled to the output terminal, gate nodes of the second transistor and the third transistor are electrically coupled to the first input terminal, a drain node of the second transistor is electrically coupled to a source node of the first transistor, and a source node of the third transistor is electrically coupled to a drain node of the fourth transistor. A drain node of the first transistor is electrically coupled to a second power supply, and a gate node of the first transistor is electrically coupled to the third input terminal. A source node of the fourth transistor is electrically coupled to a first power supply, and a gate node of the fourth transistor is electrically coupled to the second input terminal.

For example, the plurality of driver stages comprise a first driver stage to a nth driver stage and are configured such that the first input signal terminal of the first driver stage receives start pulse signals, and the first input signal terminals of other driver stages receive light emission control signals output from the light emission control output terminals of a previous driver stage.

For example, the start pulse signal has a pulse width equal to or greater than that of the light emission timing control signal.

For example, for odd numbered driver stages, the first clock terminal and the second clock terminal are configured to receive the light emission timing control signals and the inverted light emission timing control signals respectively, and for even numbered driver stages, the first clock terminal and the second clock terminal are configured to receive the inverted light emission timing control signals and the light emission timing control signals respectively.

According to another aspect of the present disclosure, there is provided a display device comprising:

a pixel array comprising a plurality of pixels each comprising a pixel driving circuit and an organic light emitting diode and connected to scan lines, data lines, light emission control lines and power supplies, the pixel driving circuit being configured to receive data signals from the data lines and control driving currents supplied to the organic light emitting diodes;

the light emission control and scan driver as describe above for providing scan signals to the scan lines and providing light emission control signals to the light emission control lines; and a data driver for providing data signals to the data lines.

For example, the display device further comprises a timing controller for providing start pulse signals, light emission timing control signals, inverted light emission timing control signals, first scan timing control signals and second scan timing control signals to the light emission control and scan driver.

For example, the pixel driving circuit is further connected to a previous scan line, and the light emission control and scan driver is further configured to provide scan signals to the previous scan line.

According to the technical proposal of the present disclosure, it is possible to effectively simplify circuit designs and reduce TFT elements and/or control timing signals required by circuits.

BRIEF DESCRIPTION OF THE DRAWINGS

The foregoing and other features and advantages of the disclosure will be apparent to those skilled in the art in view of the following detailed description, taken in conjunction with the accompanying drawings.

DETAILED DESCRIPTION

Figure 1:
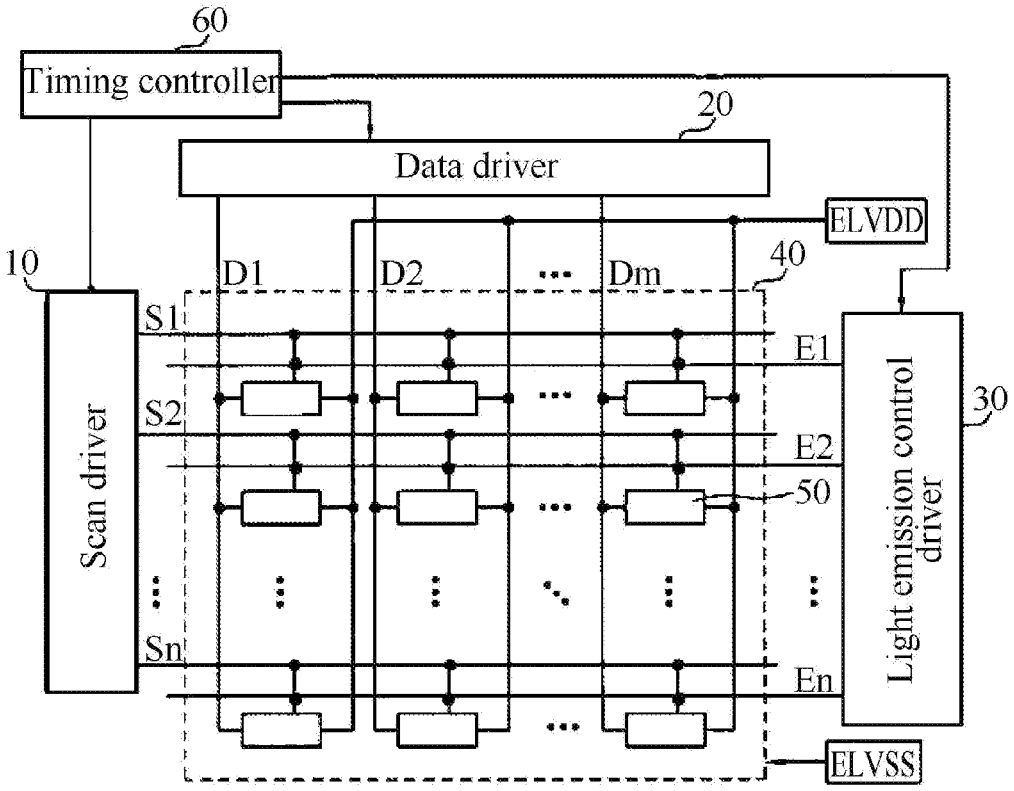
FIG. 1 schematically shows an OLED display according to conventional implementation.

Exemplary embodiments of the disclosure will now be described more fully with reference to the accompanying drawings, in which exemplary embodiments are shown. Exemplary embodiments of the disclosure may, however, be embodied in many different forms and should not be construed as being limited to the embodiments set forth herein; rather, these embodiments are provided so that this disclosure will be thorough and complete, and will fully convey the concept of exemplary embodiments to those skilled in the art. In the drawings, the thicknesses of layers and regions are exaggerated for clarity. Like reference numerals in the drawings denote like elements, and thus their description will be omitted.

The described features, structures, or/and characteristics of the disclosure may be combined in any suitable manner in one or more embodiments. In the following description, numerous specific details are disclosed to provide the thorough understanding of embodiments of the disclosure. One skilled in the relevant art will recognize, however, that the disclosure may be practiced without one or more of the specific details, or with other methods, components, materials, and so forth. In other instances, well-known structures, materials, or operations are not shown or described in detail to avoid obscuring aspects of the disclosure.

The present disclosure provides a novel driving circuit that integrates the light emission control driving circuit and the scan driving circuit to effectively simplify circuit design and the required control timing signals.

Figure 2:
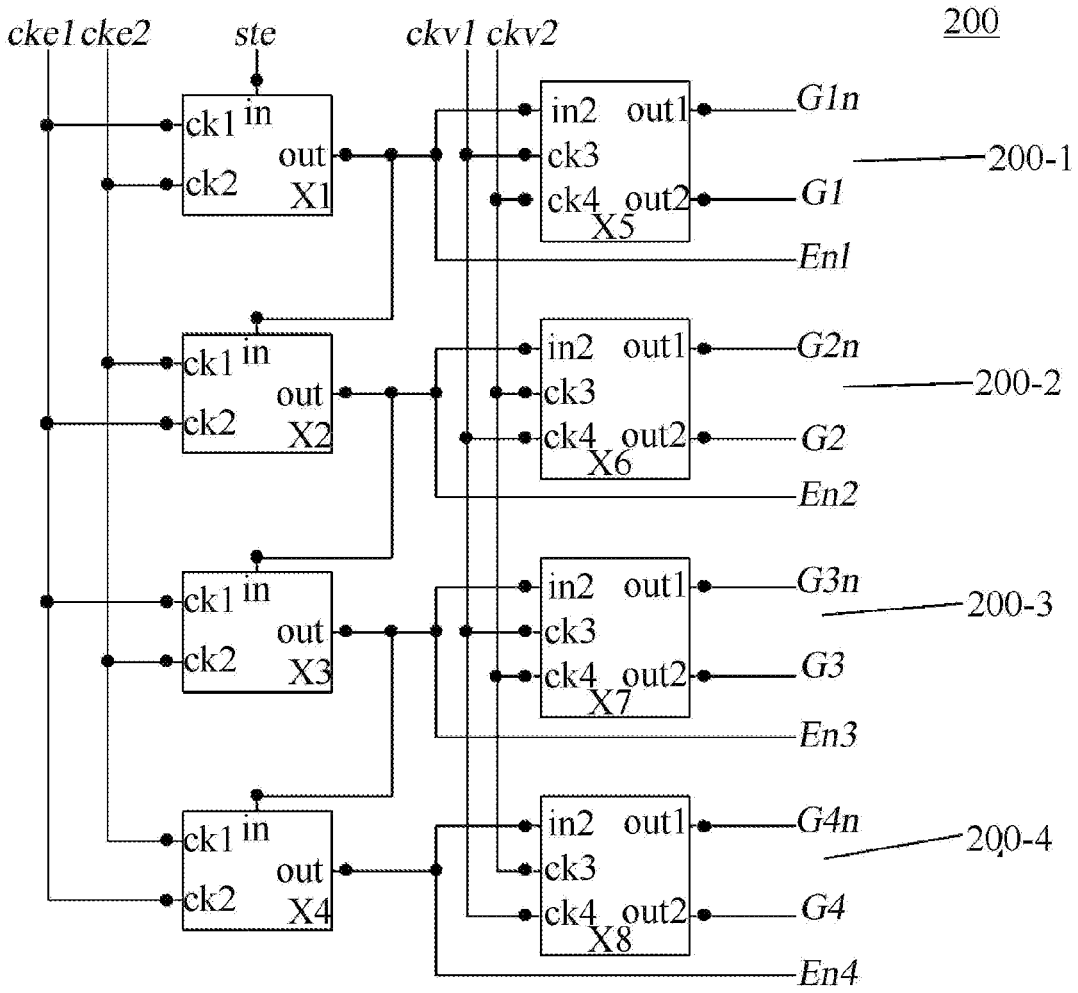
FIG. 2 shows a block diagram of a light emission control and scan driver according to an illustrative embodiment of the present disclosure.

FIG. 2 is a block diagram of a light emission control and scan driver 200 according to an illustrative embodiment of the present disclosure, which shows a driving circuit architecture according to the present disclosure.

As shown in FIG. 2, the light emission control and scan driver 200 may include a plurality of driver stages 200-1, 200-2, 200-3 and 200-4. It is easy to understand that the number of driver stages is not limited thereto. Each driver stage includes a light emission control driving unit and a scan driving unit. For example, the first driver stage 200-1 includes light emission control driving unit X1 and scan driving unit X5. The second driver stage 200-2 includes light emission control driving unit X2 and scan driving unit X6. The third driver stage 200-3 includes light emission control driving unit X3 and scan driving unit X7. The fourth driver stage 200-4 includes light emission control driving unit X4 and scan driving unit X8.

The output of the light emission control driving unit may be input into the scan driving unit to control operation of the scan driving unit.

Figure 8:
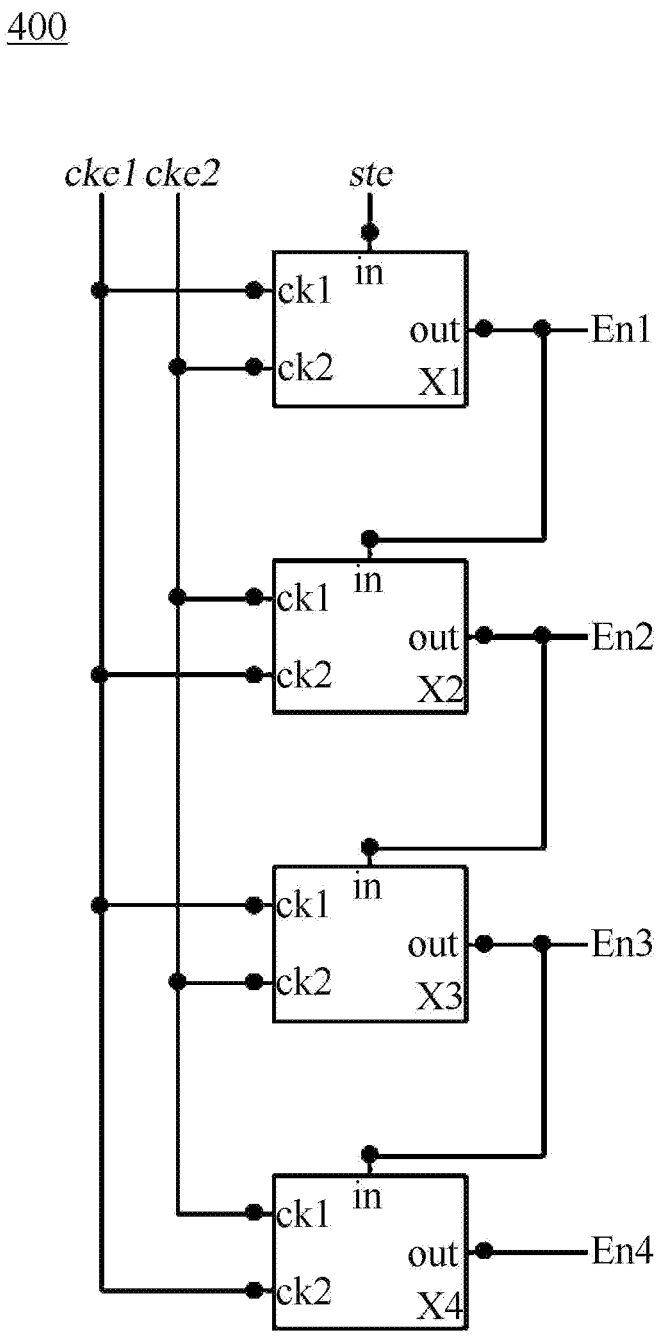
FIG. 8 shows a block diagram of a light emission control driver including a plurality of driver stages according to an illustrative embodiment of the present disclosure.

In addition, it is easy to understand that the light emission control driving unit according to the present disclosure may be used separately to constitute a light emission control driver 400 including a plurality of driver stages, as shown in FIG. 8.

The architecture of the light emission control driving unit and the scan driving unit according to the illustrative embodiment will be described below.

The light emission control driving unit includes three input terminals and one output terminal, namely the first input signal terminal in, the first clock terminal ck1, the second clock terminal ck2 and the light emission control output terminal out.

The scan driving unit includes three input terminals and two output terminals, namely the second input signal terminal in2, the third clock terminal ck3, the fourth clock terminal ck4, the first scan output terminal out1 and the second scan output terminal out2.

Figure 6:
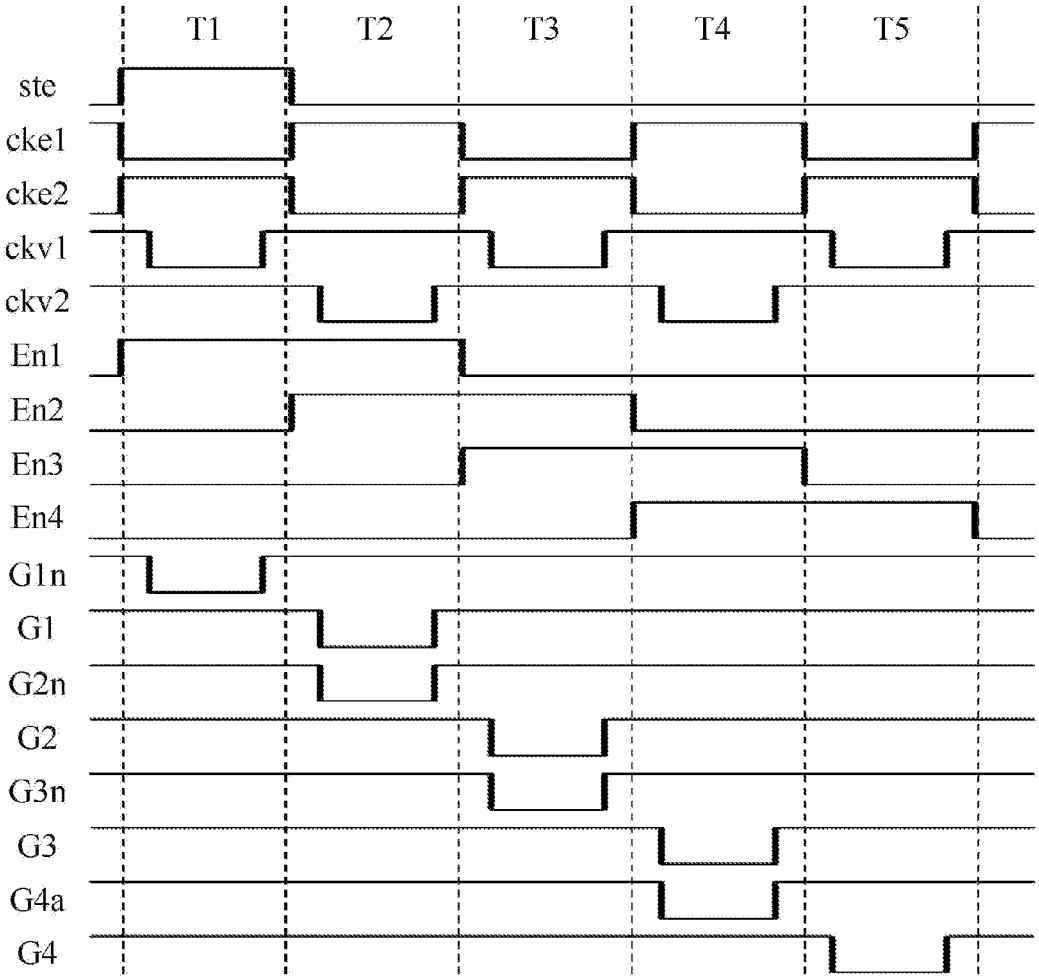
FIG. 6 shows an illustrative timing diagram for a light emission control and scan driver including four driver stages.

The three input terminals in, ck1 and ck2 of the light emission control driving unit X1 of the first driver stage 200-1 receive start pulse signal ste (namely the frame pulse signal with a period typically of 16.667 ms, see FIG. 6), light emission timing control signal cke1 and inverted light emission timing control signal cke2 respectively. The output terminal outputs light emission control signal En1 and is connected to the input signal terminal in2 of the scan driving unit X5 and the first input signal terminal of the light emission control driving unit X2 of the next driver stage 200-2.

The input terminals ck1, ck2 of the light emission control driving unit X2 of the second driver stage 200-2 are connected to signals cke2 and cke1 respectively. The output terminal out outputs light emission control signal En2 and is connected to the input signal terminal in2 of the scan driving unit X6 and the first input signal terminal of the light emission control driving unit X3 of the next driver stage 200-3.

Connections for terminals ck1 and ck2 of light emission control driving unit X3 of the third driver stage 200-3 are the same to that of X1, and X3 outputs light emission control signal En3. Connections for terminals ck1 and ck2 of light emission control driving unit X4 of the fourth driver stage 200-4 are the same to that of X2, and X4 outputs light emission control signal En4, and so on. That is, for every two driver stages, connection manners of clock signals are repeated for the light emission control driving unit.

The input terminal in2 of scan driving unit X5 of the first driver stage 200-1 is connected to the output terminal of light emission control driving unit X1 of the same stage. The third clock terminal ck3 and the fourth clock terminal ck4 are connected to the first and second scan timing control signals ckv1 and ckv2 respectively. Output terminals out1 and out2 output scan signals G1*n* and G1.

The input terminal in2 of scan driving unit X6 of the second driver stage 200-2 is connected to the output terminal of light emission control driving unit X2. The third clock terminal ck3 and the fourth clock terminal ck4 are connected to signals ckv2 and ckv1 respectively. Output terminals out1 and out2 output signals G2*n* and G2.

Connections for the third clock terminal ck3 and the fourth clock terminal ck4 of scan driving unit X7 of the third driver stage 200-3 are the same to that of X5, and X7 outputs scan signals G3*n* and G3. Connections for the third clock terminal ck3 and the fourth clock terminal ck4 of scan driving unit X8 of the fourth driver stage 200-4 are the same to that of X6, and X8 outputs scan signals G4*n* and G4, and so on. That is, for every two driver stages, connection manners of clock signals are repeated for the scan driving unit.

Figure 3:
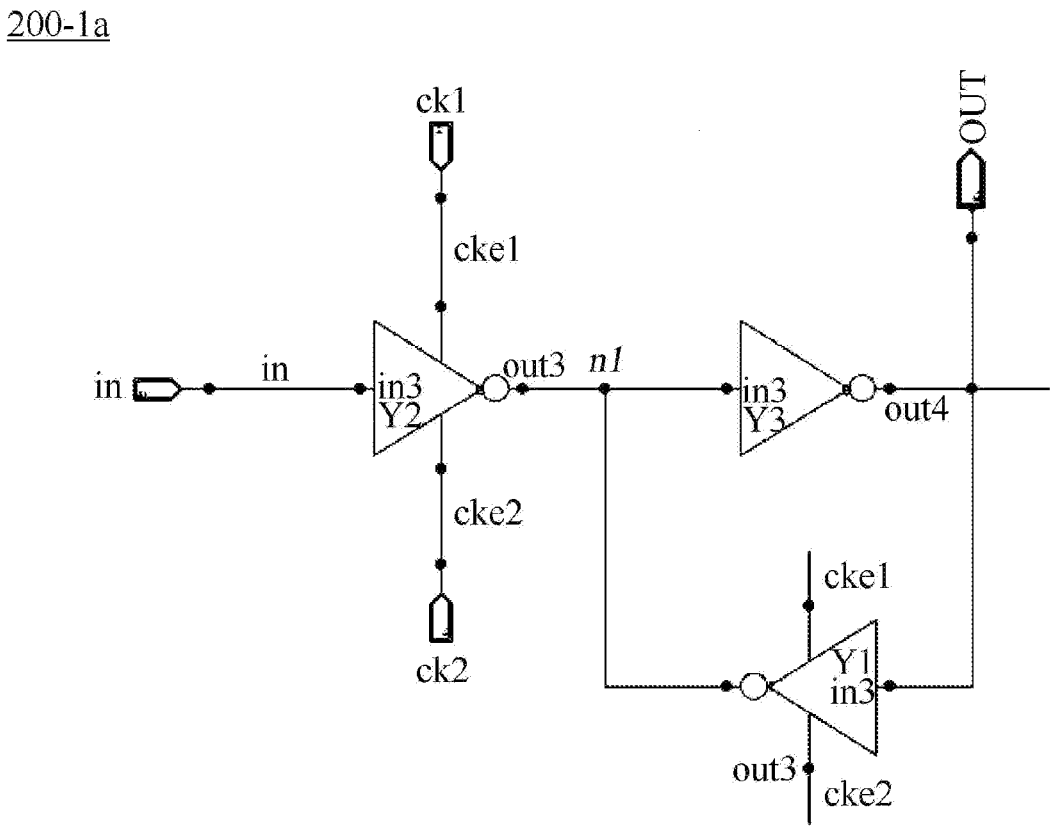
FIG. 3 shows an illustrative embodiment of a light emission control driving unit of a driver stage of the light emission control and scan driver shown in FIG. 2.

FIG. 3 shows an illustrative embodiment of a light emission control driving unit 200-1*a* of a driver stage of the light emission control and scan driver in FIG. 2.

Referring to FIG. 3, the light emission control driving unit 200-1*a* includes a first controlled inverter Y1, a second controlled inverter Y2 and a third inverter Y3.

The first controlled inverter Y1 and the second controlled inverter Y2 are inverters controlled by clock signals and each includes a first input terminal in3, a second input terminal in_p, a third input terminal in_n and an output terminal out3. When the second input terminal in_p is at low level and the third input terminal in_n is at high level, the controlled inverter is turned on, and the output terminal out3 outputs a signal with reversed phase to the signal at the first input terminal in3. On the contrary, when the second input terminal in_p is at high level while the third input terminal in_n is at low level, the controlled inverter is shut down.

The three input terminals in3, in_p and in_n of the second controlled inverter Y2 are electrically coupled to the first input signal terminal in, the first clock terminal ck1 and the second clock terminal ck2 respectively. For the first driver stage, the input terminal in3 may receive the start pulse signal ste. For other driver stages, the input terminal in3 may receive the output signal from the light emission control output terminal of the previous driver stage. Input terminals in_p and in_n may receive light emission timing control signal cke1 and inverted light emission timing control signal cke2 respectively. The output terminal out3 of the second controlled inverter Y2 is connected to node n1.

The input terminal in4 of the third inverter Y3 is connected to node n1. Y3 outputs control signal at the output terminal out4 with reversed phase to signal at node n1. The output terminal out4 of the third inverter Y3 is electrically coupled to the light emission control output terminal out.

The input terminal in3 of the first controlled inverter Y1 is electrically coupled to the output terminal of the third inverter Y3, and input terminals in_p and in_n are electrically coupled to the second clock terminal ck2 and the first clock terminal ck1 respectively and may receive signal cke2 and cke1 respectively. The output terminal out3 of the first controlled inverter Y1 is electrically coupled to node n1.

The output signal of the light emission control driving unit 200-1*a* may be input into the scan driving unit to control operation of the scan driving unit.

Figure 4:
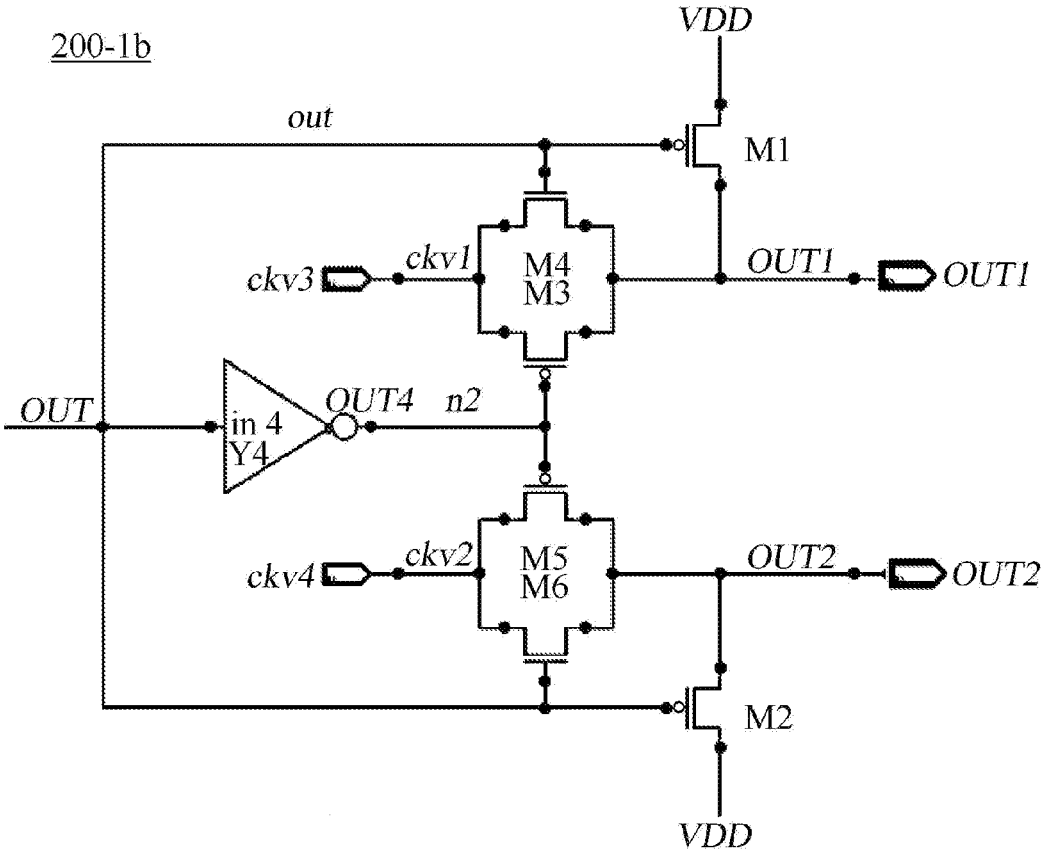
FIG. 4 shows an illustrative embodiment of a scan driving unit of a driver stage of the light emission control and scan driver shown in FIG. 2.

FIG. 4 shows an illustrative embodiment of a scan driving unit 200-1*b* of a driver stage of the light emission control and scan driver in FIG. 2.

Referring to FIG. 4, the scan driving unit 200-1*b* includes a fourth inverter Y4, a first output transistor M1, a second output transistor M2, a fourth output transistor M4, a third output transistor M3, a sixth output transistor M6 and a fifth output transistor M5. The first output transistor M1, the second output transistor M2, the third output transistor M3 and the fifth output transistor M5 may be for example PMOS transistors, while the fourth output transistor M4 and the sixth output transistor M6 may be for example NMOS transistors. However, the present invention is not limited thereto.

The input terminal in4 of the fourth inverter Y4 is electrically coupled to the output terminal out4 of the third inverter Y3. The fourth inverter Y4 outputs signals with reversed phase to signals of input terminal in4.

Source nodes of the fourth output transistor M4 and the third output transistor M3 are electrically coupled to each other and with the third clock terminal ck3, and can receive the first scan timing control signal ckv1. Drain nodes of the fourth output transistor M4 and the third output transistor M3 are electrically coupled to each other and with the first scan output terminal out1. Gate node of the fourth output transistor M4 is electrically coupled to output terminal out4 of the third inverter Y3. Gate node of the third output transistor M3 is electrically coupled to output terminal out4 of the third inverter Y4.

The fourth output transistor M4 and the third output transistor M3 may constitute an output unit that is turned on or off depending on signals output from the output terminal out4 of the third inverter Y3. It is easy to understand that the present disclosure is not limited thereto. The output unit may also be implemented in other ways. For example, the fourth output transistor M4 or the third output transistor M3 may also constitute the output unit by itself.

Similarly, source nodes of the sixth output transistor M6 and the fifth output transistor M5 are electrically coupled to each other and with the fourth clock terminal ck4, and can receive the second scan timing control signal ckv2. Drain nodes of the sixth output transistor M6 and the fifth output transistor M5 are electrically coupled to each other and with the second scan output terminal out2. Gate node of the sixth output transistor M6 is electrically coupled to output terminal of the third inverter Y3. Gate node of the fifth output transistor M5 is electrically coupled to output terminal of the fourth inverter Y4.

Source node of the first output transistor M1 may be electrically coupled to the power supply VDD. Drain node of the first output transistor M1 may be electrically coupled to the first scan output terminal out1. Gate node of the first output transistor M1 may be electrically coupled to output terminal out4 of the third inverter Y3.

Source node of the second output transistor M2 may be electrically coupled to the power supply VDD. Drain node of the second output transistor M2 may be electrically coupled to the second scan output terminal out2. Gate node of the second output transistor M2 may be electrically coupled to output terminal out4 of the third inverter Y3.

Operations of the light emission control driving unit and the scan driving unit according to illustrative embodiments of the present disclosure will be described below with reference to timing diagrams.

Figure 5:
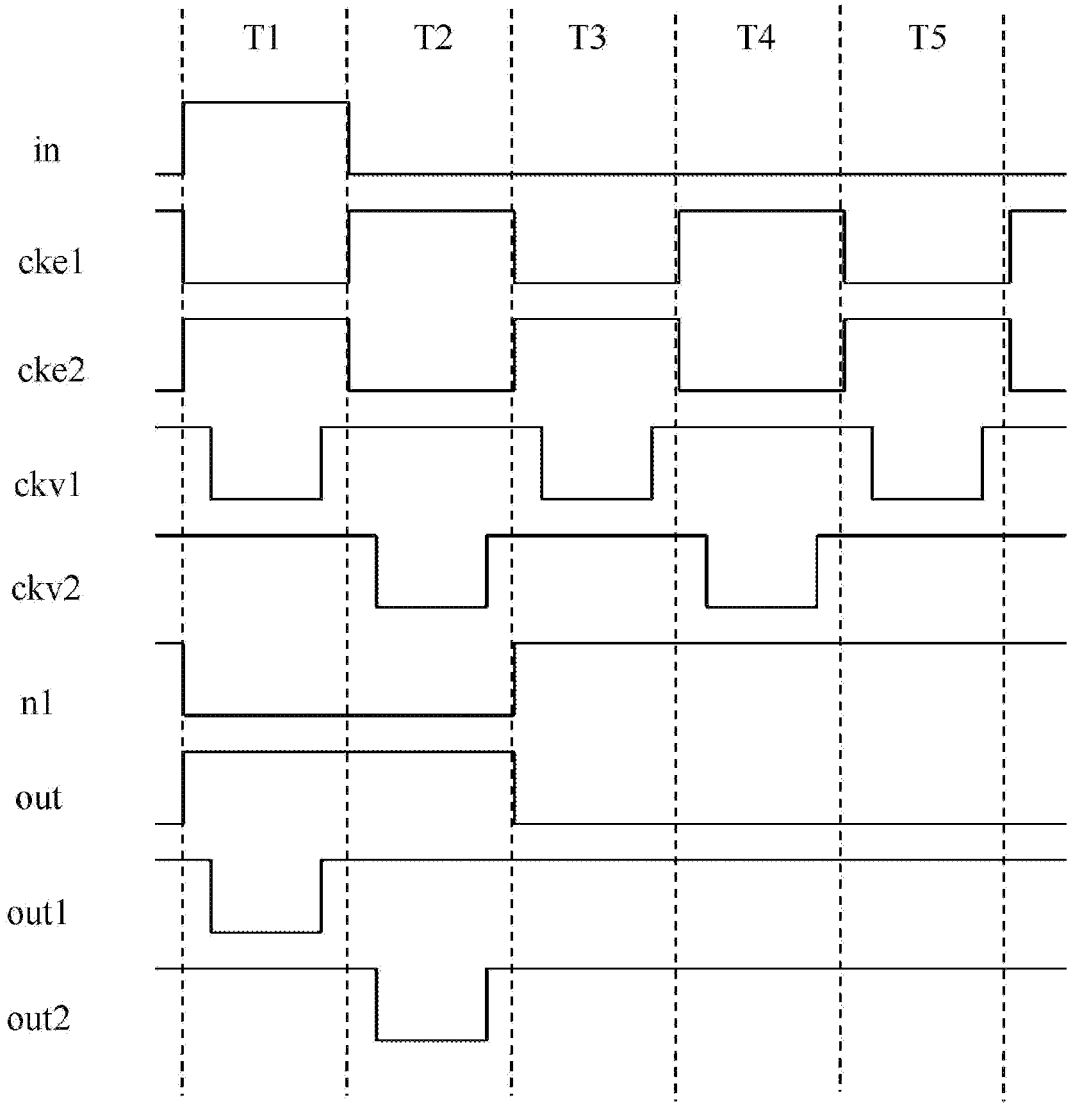
FIG. 5 shows an illustrative timing diagram applicable to the driver stage circuit of the light emission control driving unit and the scan driving unit shown in FIGS. 3 and 4.

FIG. 5 shows an illustrative timing diagram applicable to the driver stage circuit of the light emission control driving unit and the scan driving unit shown in FIGS. 3 and 4.

The following description is presented with the first driver stage 200_1 as an example. However, it is easy to understand the following description is also applicable to other driver stages. Specifically, for the first driver stage, the first input terminal in may receive the start pulse signal ste. For other driver stages, the input terminal in may receive the output signal of the light emission control output terminal of the previous driver stage. For odd numbered driver stages, the first clock terminals ck1 and the second clock terminals ck2 can receive light emission timing control signals cke1 and inverted light emission timing control signals cke2 respectively, and the third clock terminals ck3 and the fourth clock terminals ck4 can receive the first scan timing control signals ckv1 and the second scan timing control signals ckv2 respectively. For even numbered driver stages, the first clock terminals ck1 and the second clock terminals ck2 can receive inverted light emission timing control signals cke2 and light emission timing control signals cke1 respectively, and the third clock terminals ck3 and the fourth clock terminals ck4 can receive the second scan timing control signals ckv2 and the first scan timing control signals ckv1 respectively.

Referring to FIGS. 3 to 5, in the first time interval T1, the input signal of the first input signal terminal is at high level, the light emission timing control signal cke1 is at low level, and the inverted light emission timing control signal cke2 is at high level. Therefore, the terminal in_p of the first controlled inverter Y1 is at high level, the terminal in_n is at low level. The terminal in_p of the second controlled inverter Y2 is at low level and the terminal in_n is at high level. As such, the first controlled inverter Y1 is turned off, and the second controlled inverter Y2 is turned on.

Therefore, the output of the second controlled inverter Y2 is an inverted signal of the input signal, that is, node n1 is at low level.

The output of the third inverter Y3 is at high level, that is, the output signal of the light emission control output terminal out (referring to FIGS. 2 and 6, En1) is at high level. The output of the fourth inverter Y4 is at low level.

Since gate nodes of the first output transistor M1 and the second output transistor M2 are electrically coupled to the output terminal of the third inverter Y3, the first output transistor M1 and the second output transistor M2 are turned off.

Since gate nodes of the fourth output transistor M4 and the sixth output transistor M6 are electrically coupled to output terminal of the third inverter Y3, gate nodes of the third output transistor M3 and the fifth output transistor M5 are electrically coupled to the output terminal of the fourth inverter Y4, output transistors M3, M4, M5, and M6 are turned on. As a result, the first scan output terminal out1 outputs the first scan timing control signal ckv1, that is out1=ckv1; while the second scan output terminal out2 outputs the second scan timing control signal ckv2, that is out2=ckv2. That is, referring to FIGS. 2 and 6, output signals G1*n* and G1 are the first scan timing control signal ckv1 and the second scan timing control signal ckv2 respectively.

In the second time interval T2, the input signal of the first input signal terminal in is at low level, the light emission timing control signal cke1 is at high level, and the inverted light emission timing control signal cke2 is at low level. Therefore, the terminal in_p of the first controlled inverter Y1 is at low level, the terminal in_n is at high level, the terminal in_p of the second controlled inverter Y2 is at high level and the terminal in_n is at low level. As such, the first controlled inverter Y1 is turned on, and the second controlled inverter Y2 is turned off. The third inverter Y3 and the first inverter Y1 form a locking loop to keep n1 at low level. The light emission control output terminal out is maintained at high level. The output of the fourth inverter Y4 is at low level.

Since gate nodes of the first output transistor M1 and the second output transistor M2 are electrically coupled to the output terminal of the third inverter Y3, the first output transistor M1 and the second output transistor M2 maintain in the off state.

Since gate nodes of the fourth output transistor M4 and the sixth output transistor M6 are electrically coupled to output terminal of the third inverter Y3, gate nodes of the third output transistor M3 and the fifth output transistor M5 are electrically coupled to the output terminal of the fourth inverter Y4, output transistors M3, M4, M5 and M6 maintain in the on state. As a result, the first scan output terminal out1 outputs the first scan timing control signal ckv1, that is out1=ckv1; while the second scan output terminal out2 outputs the second scan timing control signal ckv2, that is out2=ckv2.

In the third time interval T3, the input signal of the first input signal terminal in is at low level, the light emission timing control signal cke1 is at low level, and the inverted light emission timing control signal cke2 is at high level. Therefore, the terminal in_p of the first controlled inverter Y1 is at high level, the terminal in_n is at low level. The terminal in_p of the second controlled inverter Y2 is at low level and the terminal in_n is at high level. As such, the first controlled inverter Y1 is turned off, and the second controlled inverter Y2 is turned on.

Therefore, the output of the second controlled inverter Y2 is an inverted signal of the input signal, that is, node n1 is at high level.

The output of the third inverter Y3 is at low level, that is, the light emission control output terminal out is at low level. The output of the fourth inverter Y4 is at high level.

Since gate nodes of the first output transistor M1 and the second output transistor M2 are electrically coupled to the output terminal of the third inverter Y3, the first output transistor M1 and the second output transistor M2 are turned on.

Since gate nodes of the fourth output transistor M4 and the sixth output transistor M6 are electrically coupled to output terminal of the third inverter Y3, gate nodes of the third output transistor M3 and the fifth output transistor M5 are electrically coupled to the output terminal of the fourth inverter Y4, output transistors M3, M4, M5 and M6 are turned off. As a result, the first and second scan output terminals out1 and out2 output VDD signal, and thus are at high level, that is, out1=VDD, out2=VDD.

In the fourth time interval T4, the input signal of the first input signal terminal in is at low level, the light emission timing control signal cke1 is at high level, and the inverted light emission timing control signal cke2 is at low level. Therefore, the terminal in_p of the first controlled inverter Y1 is at low level, the terminal in_n is at high level, the terminal in_p of the second controlled inverter Y2 is at high level and the terminal in_n is at low level. As such, the first controlled inverter Y1 is turned on, and the second controlled inverter Y2 is turned off. The third inverter Y3 and the first inverter Y1 form a locking loop to keep n1 at high level. The light emission control output terminal out is maintained at low level. The output of the fourth inverter Y4 is at high level.

Since gate nodes of the first output transistor M1 and the second output transistor M2 are electrically coupled to the output terminal of the third inverter Y3, the first output transistor M1 and the second output transistor M2 are turned on.

Since gate nodes of the fourth output transistor M4 and the sixth output transistor M6 are electrically coupled to output terminal of the third inverter Y3, gate nodes of the third output transistor M3 and the fifth output transistor M5 are electrically coupled to the output terminal of the fourth inverter Y4, output transistors M3, M4, M5 and M6 are turned off. As a result, the first and second scan output terminals out1 and out2 output VDD signal, and thus are at high level, that is, out1=VDD, out2=VDD.

In the fifth time interval T5, the input signal of the first input signal terminal in is at low level, the light emission timing control signal cke1 is at low level, and the inverted light emission timing control signal cke2 is at high level. Therefore, the terminal in_p of the first controlled inverter Y1 is at high level, the terminal in_n is at low level, the terminal in_p of the second controlled inverter Y2 is at low level and the terminal in_n is at high level. As such, the first controlled inverter Y1 is turned off, and the second controlled inverter Y2 is turned on.

Therefore, the output of the second controlled inverter Y2 is an inverted signal of the input signal, that is, node n1 is at high level.

The output of the third inverter Y3 is at low level, that is, the light emission control output terminal out is at low level. The output of the fourth inverter Y4 is at high level.

Since gate nodes of the first output transistor M1 and the second output transistor M2 are electrically coupled to the output terminal of the third inverter Y3, the first output transistor M1 and the second output transistor M2 are turned on.

Since gate nodes of the fourth output transistor M4 and the sixth output transistor M6 are electrically coupled to output terminal of the third inverter Y3, gate nodes of the third output transistor M3 and the fifth output transistor M5 are electrically coupled to the output terminal of the fourth inverter Y4, output transistors M3, M4, M5 and M6 are turned off. As a result, the first and second scan output terminals out1 and out2 output VDD signal, and thus are at high level, that is, out1=VDD, out2=VDD.

As can be seen, in the third time interval T3 and after T3, node n1 maintains at high level, the light emission control output terminal out maintains at low level, and output signals of the first and second scan output terminals out1 and out2 (referring to FIGS. 2 and 6, G1*n* and G1) maintain at high level. In addition, as shown in FIG. 5, the high level output signal of the light emission control output terminal out corresponds to one period of the light emission timing control signal cke1. The low level outputs of the first and second scan output terminals out1 and out2 are in phase with the first and second scan timing control signals ckv1 and ckv2.

Referring to FIGS. 2-6, for the second driver stage, the input terminal in may receive the output signal of the light emission control output terminal of the first driver stage. The first clock terminals ck1 and the second clock terminals ck2 can receive inverted light emission timing control signals cke2 and light emission timing control signals cke1 respectively, and the third clock terminals ck3 and the fourth clock terminals ck4 can receive the second scan timing control signals ckv2 and the first scan timing control signals ckv1 respectively.

In the first time interval T1, the input signal of the first input signal terminal of the second driver stage (namely, the output signal of the light emission control output terminal of the first driver stage) is at high level, the light emission timing control signal cke1 is at low level, and the inverted light emission timing control signal cke2 is at high level. Therefore, the terminal in_p of the first controlled inverter Y1 of the second driver stage is at low level, and the terminal in_n is at high level. The terminal in_p of the second controlled inverter Y2 is at high level, and terminal in_n is at low level. As such, the first controlled inverter Y1 is turned on, and the second controlled inverter Y2 is turned off. Referring to the above description of the first driver stage, it is easy to understand that after being turned on once (after the first frame), the third inverter Y3 and the first inverter Y1 form a locking loop to keep n1 at high level, the light emission control output terminal out maintains at low level, and the output of the fourth inverter Y4 is at high level.

Referring to FIG. 5 and the above description for the first driver stage, at this point, outputs of the first and second scan output terminals out1 and out2 of the second driver stage are at high level.

Similarly, referring to FIG. 5 and the above description for the first driver stage, in the second and third time intervals T2 and T3, the output signal En2 of the light emission control output terminal of the second driver stage is at high level, output signals G2*n* and G2 of the first and second scan output terminals out1 and out2 of the second driver stage are respectively the second scan timing control signal ckv2 and the first scan timing control signal ckv1. In the fourth time interval T4 and after T4, the output signal En2 of the light emission control output terminal of the second driver stage maintains at low level, the output signals G2*n* and G2 of the first and second scan output terminals out1 and out2 of the second driver stage maintain at high level.

The output timing state of other driver stages may be obtained similarly as shown in FIG. 6, which shows an illustrative timing diagram for a light emission control and scan driver 200 including four driver stages each including a light emission control driving unit and a scan driving unit as shown in FIGS. 3-4.

The operating principle and illustrative timing diagrams of the light emission control and scan driver according to the present disclosure have been described above with reference to FIGS. 5 and 6. However, the present disclosure is not limited thereto. For example, timings of ckv2 and ckv1 may be adjusted according to signals required for driving pixels. As another example, the start pulse signal ste may have a pulse width that is greater than that of the light emission timing control signal cke1 but smaller than one period of the light emission timing control signal cke1.

Figure 7:
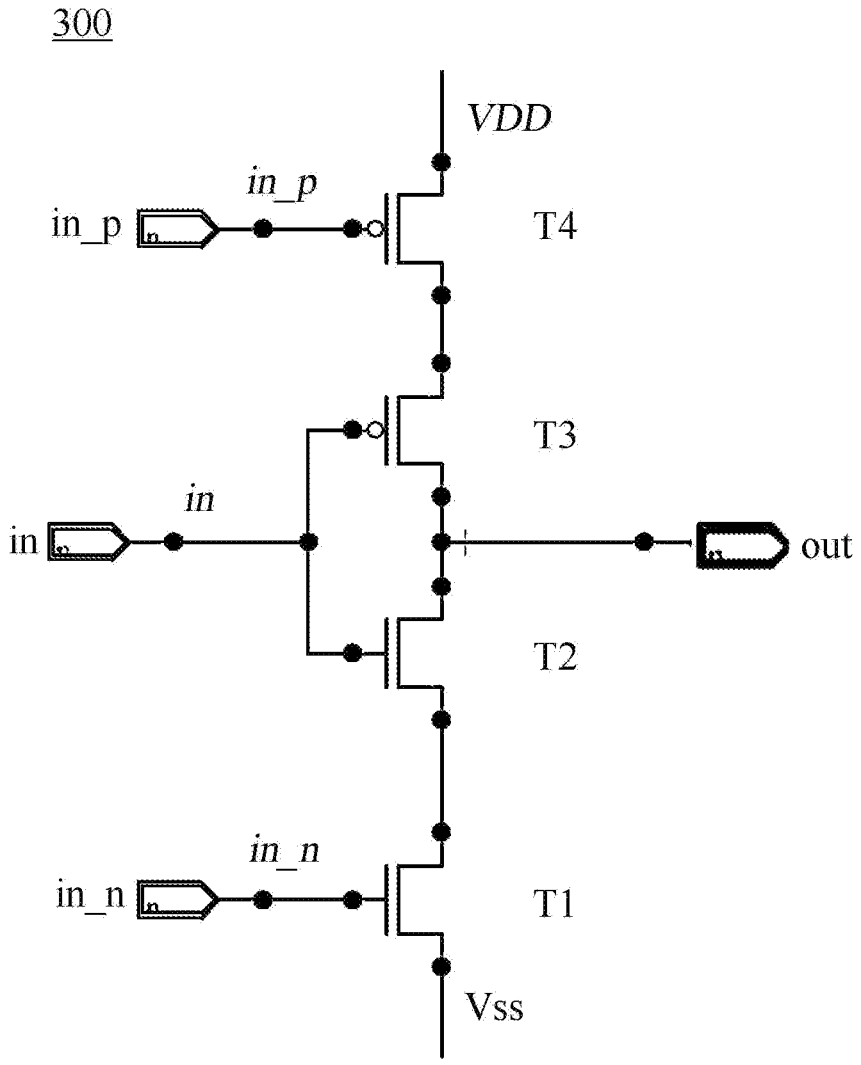
FIG. 7 shows a circuit diagram of an illustrative embodiment of a controlled inverter in the illustrative driver stage shown in FIG. 3.

FIG. 7 shows a circuit diagram of an illustrative embodiment of a controlled inverter 300 for use in the illustrative driver stage shown in FIG. 3.

The controlled inverter 300 includes a first transistor T1, a second transistor T2, a third transistor T3 and a fourth transistor T4. The first transistor T1 and the second transistor T2 may be for example NMOS transistors, and the third transistor T3 and the fourth transistor T4 may be for example PMOS transistors.

Source node of the second transistor T2 and drain node of the third transistor T3 are electrically coupled to the output terminal of the controlled inverter 300, gate nodes of the second transistor T2 and the third transistor T3 are electrically coupled to the first input terminal, drain node of the second transistor T2 is electrically coupled to source node of the first transistor T1, and source node of the third transistor T3 is electrically coupled to drain node of the fourth transistor T4.

Drain node of the first transistor T1 is electrically coupled to the second power supply VSS, and gate node of the first transistor T1 is electrically coupled to the third input terminal in_n.

Source node of the fourth transistor T3 is electrically coupled to the first power supply VDD, and gate node of the fourth transistor T4 is electrically coupled to the second input terminal in_p.

Those skilled in the art can understand the operating principle of the circuit shown in FIG. 7, which will not be described herewith for clarity. Apparently, the present disclosure is not limited thereto and the controlled inverter may be implemented in other ways.

According to illustrative embodiments, the light emission control driving circuit and the scan driving circuit are integrated together to effectively simplify circuit design and the required control timing signals.

Figure 9:
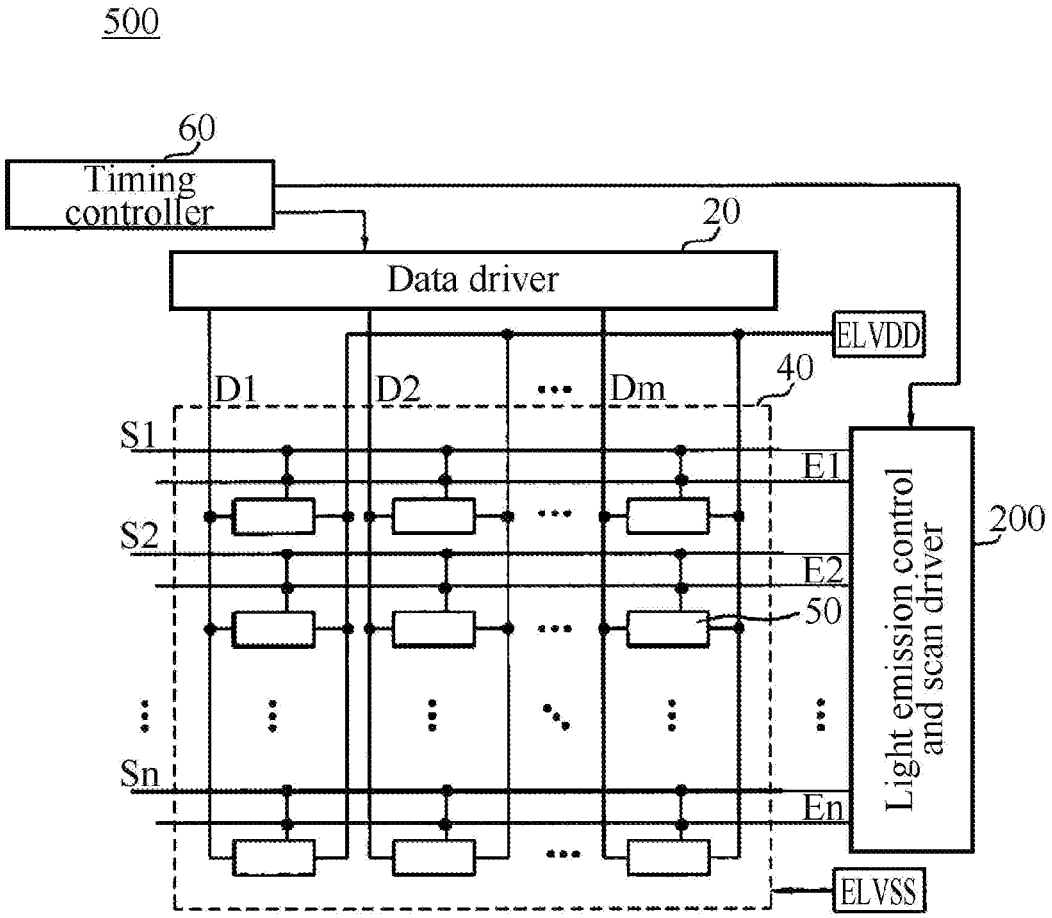
FIG. 9 shows a display device according to an illustrative embodiment of the present disclosure.

FIG. 9 shows a display device 900 according to an illustrative embodiment of the present disclosure.

Figure 10:
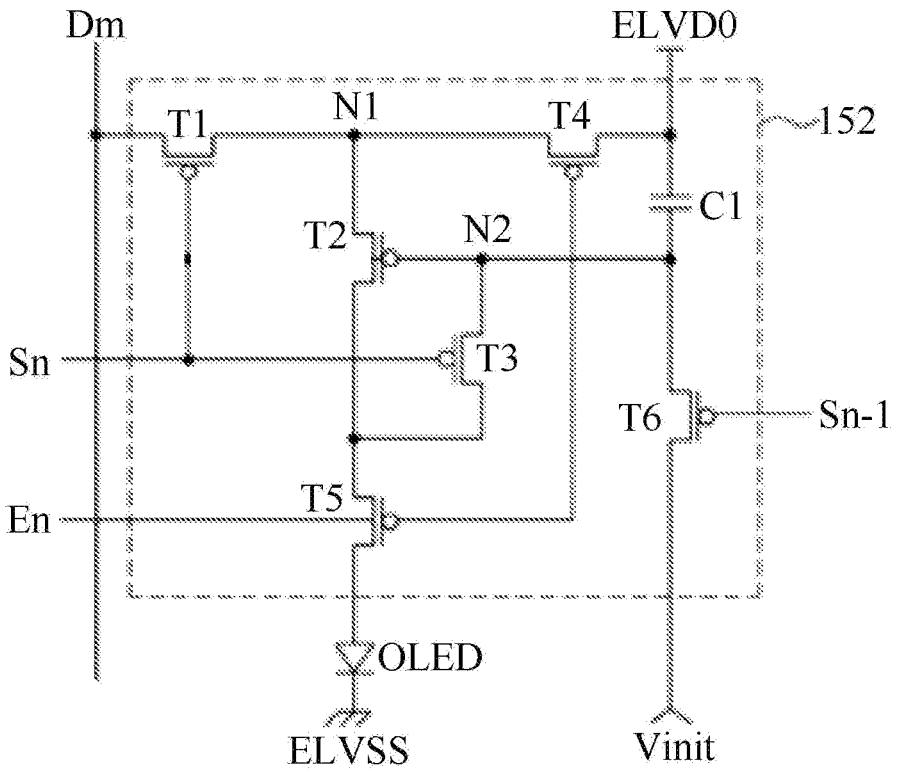
FIG. 10 shows an illustrative embodiment for the pixel driving circuit of the display device shown in FIG. 9.

FIG. 10 shows an illustrative embodiment of the pixel driving circuit applicable to the display device shown in FIG. 9. The pixel driving circuit shown in FIG. 10 is similar to that commonly used in the art and detail description thereof will be omitted.

The display device 500 according to an illustrative embodiment of the present disclosure will be described below with reference to FIGS. 9 and 10.

Referring to FIGS. 9 and 10, the display device 500 includes a pixel array 40. The pixel array 40 includes a plurality of pixels 50 each including a pixel driving circuit 152 and an organic light emitting diode OLED and connected to scan lines S1 to Sn, data lines D1 to Dm, light emission control lines E1 to En, a first power supply ELVDD and a second power supply ELVSS. The pixel driving circuit receives data signals from the data lines and controls driving currents supplied to the organic light emitting diodes.

The display device 500 further includes the light emission control and scan driver 200 according to the present disclosure as described above for providing scan signals to the scan lines and providing light emission control signals to the light emission control lines and a data driver 20 for providing data signals to the data lines.

The display device 500 may further include a timing controller 60 for providing start pulse signals, light emission timing control signals, inverted light emission timing control signals, first scan timing control signals and second scan timing control signals to the light emission control and scan driver.

It is easy to understand that the illustrated and described embodiments of light emission control driver, light emission control and scan driver and display device are only for illustration rather than limiting the present invention.

For example, depending on specific pixel driving circuits, it is also possible to omit the second scan output terminal out2 and relevant circuits. That is, the output transistors M2, M5 and M6, and the fourth input terminal ck4 and the second scan output terminal out2 in the scan driving unit are omitted. Then the output signals do not include signals G1, G2, . . . Gn. Alternatively, it is also possible to combine output signals G1 and G1*n* into a scan signal including a plurality of pulse trains.

As another example, the output signal of the light emission control output terminal out may be inverted by adding an inverter.

Illustrative embodiments of the present disclosure have been shown and described in particular above. It is understood that the present disclosure is not limited to the disclosed embodiments but rather intended to encompass various modifications and equivalent arrangements within the spirit and scope of the appended claims.

What is claimed is:

1. A light emission control and scan driver having a plurality of driver stages for outputting light emission control signals and scan signals, each driver stage comprises:

a light emission control driving unit having a first input signal terminal for receiving an input signal, a first clock terminal for receiving a light emission timing control signal, a second clock terminal for receiving an inverted light emission timing control signal, and a light emission control output terminal for outputting a light emission control signal, the light emission control driving unit is configured to output the light emission control signal at the light emission control output terminal based on the input signal at the first input signal terminal, the light emission timing control signal at the first clock terminal, and the inverted light emission timing control signal at the second clock terminal, wherein the inverted light emission timing control signal is an inverted signal of the light emission timing control signal; and a scan driving unit having a second input signal terminal for receiving a control signal, a third clock terminal for receiving a first scan timing control signal, a fourth clock terminal for receiving a second scan timing control signal and at least one scan output terminal for outputting at least one scan signal, the scan driving unit is configured to output the at least one scan signal at the at least one scan output terminal according to the control signal at the second input signal terminal obtained on the basis of the light emission control signal from the light emission control driving unit, the first scan timing control signal at the third clock terminal, and the second scan timing control signal at the fourth clock terminal, wherein for odd numbered driver stages, the first clock terminal and the second clock terminal of light emission control driving unit are configured to receive the light emission timing control signal and the inverted light emission timing control signal respectively, and the third clock terminal and the fourth clock terminal are configured to receive the first scan timing control signal and the second scan timing control signal respectively, and for even numbered driver stages, the first clock terminal and the second clock terminal are configured to receive the inverted light emission timing control signal and the light emission timing control signal respectively, and the third clock terminal and the fourth clock terminal are configured to receive the second scan timing control signal and the first scan timing control signal respectively.

2. The light emission control and scan driver of claim 1, wherein the light emission control signal is taken as the control signal.

3. The light emission control and scan driver of claim 1, wherein the light emission control driving unit comprises a first controlled inverter, a second controlled inverter and a third inverter, wherein each of the first controlled inverter and the second controlled inverter comprises a first input terminal for receiving a first signal, a second input terminal for receiving a second signal, a third input terminal for receiving a third signal and an output terminal for outputting a signal, and the first controlled inverter and the second controlled inverter are configured that: when the second signal at the second input terminal is at low level and the third signal at the third input terminal is at high level, the first controlled inverter and the second controlled inverter are turned on and output the signal at the output terminal with a reversed phase to the first signal at the first input terminal, and when the second signal at the second input terminal is at high level and the third signal at the third input terminal is at low level, the first controlled inverter and the second controlled inverter are turned off, wherein the first input terminal, the second input terminal and the third input terminal of the first controlled inverter are respectively electrically coupled to the output terminal of the third inverter, and the second clock terminal and the first clock terminal of the light emission control driving unit, and the output terminal of the first controlled inverter is electrically coupled to an input terminal of the third inverter, wherein the first input terminal, the second input terminal and the third input terminal of the second controlled inverter are respectively electrically coupled to the first input signal terminal, the second clock terminal and the first clock terminal of the light emission control driving unit, and the output terminal of the second controlled inverter is electrically coupled to the input terminal of the third inverter.

4. The light emission control and scan driver of claim 3, wherein an output terminal of the third inverter is directly or indirectly electrically coupled to the light emission control output terminal of the light emission control driving unit.

5. The light emission control and scan driver of claim 3, wherein each of the first controlled inverter and the second controlled inverter comprises: a first transistor, a second transistor, a third transistor and a fourth transistor, wherein the first transistor and the second transistor are NMOS transistors, and the third transistor and the fourth transistor are PMOS transistors, wherein a source node of the second transistor and a drain node of the third transistor of each of the first controlled inverter and the second controlled inverter are electrically coupled to respective output terminals of the first controlled inverter and the second controlled inverter, gate nodes of the second transistor and the third transistor of each of the first controlled inverter and the second controlled inverter are electrically coupled to respective first input terminals of the first controlled inverter and the second controlled inverter, a drain node of the second transistor of each of the first controlled inverter and the second controlled inverter is electrically coupled to respective source nodes of the first transistors of the first controlled inverter and the second controlled inverter, and a source node of the third transistor of each of the first controlled inverter and the second controlled inverter is electrically coupled to respective drain nodes of the fourth transistors of the first controlled inverter and the second controlled inverter, wherein a drain node of the first transistor of each of the first controlled inverter and the second controlled inverter is electrically coupled to a second power supply, and a gate node of the first transistor of each of the first controlled inverter and the second controlled inverter is electrically coupled to respective third input terminals of the first controlled inverter and the second controlled inverter, wherein a source node of the fourth transistor of each of the first controlled inverter and the second controlled inverter is electrically coupled to a first power supply, and a gate node of the fourth transistor of each of the first controlled inverter and the second controlled inverter is electrically coupled to respective second input terminals of the first controlled inverter and the second controlled inverter.

6. The light emission control and scan driver of claim 3, wherein the scan driving unit comprises a fourth inverter, a first output transistor, a second output transistor, complementary third and fourth output transistors, complementary fifth and sixth output transistors, the at least one scan output terminal of the scan driving unit comprises a first scan output terminal and a second scan output terminal, wherein an input terminal of the fourth inverter is electrically coupled to an output terminal of the third inverter of the light emission control driving unit, wherein a source node of the first output transistor is electrically coupled to a first power supply, a drain node of the first output transistor is electrically coupled to the first scan output terminal of the scan driving unit, and a gate node of the first output transistor is electrically coupled to an output terminal of the third inverter of the light emission control driving unit, wherein a source node of the second output transistor is electrically coupled to a first power supply, a drain node of the second output transistor is electrically coupled to the second scan output terminal of the scan driving unit, and a gate node of the second output transistor is electrically coupled to an output terminal of the third inverter of the light emission control driving unit, wherein source nodes of the third output transistor and the fourth output transistor are electrically coupled to each other and with the third clock terminal of the scan driving unit, drain nodes of the third output transistor and the fourth output transistor are electrically coupled to each other and with the first scan output terminal of the scan driving unit, a gate node of the third output transistor is electrically coupled to an output terminal of the third inverter of the light emission control driving unit, and a gate node of the fourth output transistor is electrically coupled to an output terminal of the fourth inverter, and wherein source nodes of the fifth output transistor and the sixth output transistor are electrically coupled to each other and with the fourth clock terminal of the scan driving unit, drain nodes of the fifth output transistor and the sixth output transistor are electrically coupled to each other and with the second scan output terminal of the scan driving unit, a gate node of the fifth output transistor is electrically coupled to an output terminal of the third inverter of the light emission control driving unit, and a gate node of the sixth output transistor is electrically coupled to an output terminal of the fourth inverter.

7. The light emission control and scan driver of claim 1, wherein the plurality of driver stages comprise a first driver stage to a nth driver stage and are configured such that the first input signal terminal of the light emission control driving unit of the first driver stage receives a start pulse signal, and the first input signal terminals of the light emission control driving units of other driver stages receive respective light emission control signals from the light emission control output terminals of respective previous driver stages.

8. The light emission control and scan driver of claim 7, wherein the start pulse signal has a pulse width equal to or greater than that of the light emission timing control signal.

9. The light emission control and scan driver of claim 1, wherein the scan driving unit comprises at least one output unit each comprising:

a first output transistor having a source node electrically coupled to a first power supply, a drain node electrically coupled to one scan output terminal of the at least one scan output terminal of the scan driving unit, and a gate node electrically coupled to the second input signal terminal of the scan driving unit, the first output transistor is configured to be turned on or off based on the control signal from the second input signal terminal of the scan driving unit;

a first output unit having an input terminal electrically coupled to one of the third clock terminal and the fourth clock terminal of the scan driving unit, and an output terminal electrically coupled to the one scan output terminal of the at least one scan output terminal of the scan driving unit, the first output unit is configured to be turned on or off according to the control signal from the second input signal terminal of the scan driving unit.

10. The light emission control and scan driver of claim 9, wherein the first output unit is configured to output signal input at the input terminal while being turned on.

11. The light emission control and scan driver of claim 9, wherein the first output unit comprises complementary second and third output transistors, wherein a source node of the second output transistor and a source node of the third output transistor are electrically coupled to the input terminal of the first output unit, a drain node of the second output transistor and a drain node of the third output transistor are electrically coupled to the output terminal of the first output unit, a gate node of the second output transistor is configured to receive the control signal, and a gate node of the third output transistor is configured to receive an inverted signal of the control signal.

12. A display device comprising:

a pixel array comprising a plurality of pixels, each pixel comprises a pixel driving circuit and an organic light emitting diode and is connected to a scan line, a data line, a light emission control line and a power supply, the pixel driving circuit is configured to receive a data signal from the data line and to control a driving current supplied to the organic light emitting diode;

the light emission control and scan driver of claim 1 for providing scan signal to the scan line and providing light emission control signal to the light emission control line; and a data driver for providing a data signal to the data line.

13. The display device of claim 12, further comprising a timing controller for providing a start pulse signal, a light emission timing control signal, an inverted light emission timing control signal, a first scan timing control signal and a second scan timing control signal to the light emission control and scan driver.

14. The display device of claim 12, wherein the pixel driving circuit is further connected to a previous scan line, and the light emission control and scan driver is further configured to provide a scan signal to the previous scan line.

* * * * *